US009867440B2

(12) United States Patent
Lawrenson

(10) Patent No.: US 9,867,440 B2
(45) Date of Patent: Jan. 16, 2018

(54) STORAGE CASE

(71) Applicant: Lindi Lawrenson, St. Quen (GB)

(72) Inventor: Lindi Lawrenson, St. Quen (GB)

( * ) Notice: Subject to any disclaimer, the term of this patent is extended or adjusted under 35 U.S.C. 154(b) by 76 days.

(21) Appl. No.: 15/033,972

(22) PCT Filed: Nov. 5, 2014

(86) PCT No.: PCT/GB2014/053297

§ 371 (c)(1),
(2) Date: May 3, 2016

(87) PCT Pub. No.: WO2015/067944

PCT Pub. Date: May 14, 2015

(65) Prior Publication Data

US 2016/0270499 A1 Sep. 22, 2016

(30) Foreign Application Priority Data

Nov. 6, 2013 (GB) ..... 1319565.6

(51) Int. Cl.

| | |
|---|---|
| ***B65D 71/00*** | (2006.01) |
| ***A45C 11/24*** | (2006.01) |
| ***A45C 5/00*** | (2006.01) |
| ***A45C 11/16*** | (2006.01) |
| ***A45C 11/20*** | (2006.01) |
| ***A45C 11/34*** | (2006.01) |
| ***A45C 7/00*** | (2006.01) |
| ***A45C 13/02*** | (2006.01) |
| ***A45C 13/10*** | (2006.01) |
| ***A45C 13/26*** | (2006.01) |
| ***A45C 15/00*** | (2006.01) |

(52) U.S. Cl.

CPC ..... *A45C 11/24* (2013.01); *A45C 5/005* (2013.01); *A45C 7/0045* (2013.01); *A45C 11/16* (2013.01); *A45C 11/20* (2013.01); *A45C 11/34* (2013.01); *A45C 13/02* (2013.01); *A45C 13/1069* (2013.01); *A45C 13/26* (2013.01); *A45C 15/00* (2013.01); *A45C 2013/026* (2013.01)

(58) Field of Classification Search

USPC ..... 206/574, 575, 576, 578

See application file for complete search history.

(56) References Cited

U.S. PATENT DOCUMENTS

| | | | |
|---|---|---|---|
| 1,930,347 | A | 10/1933 | Meyer et al. |
| 2,983,367 | A | 5/1961 | Parmater et al. |
| 3,744,084 | A | 7/1973 | Fankhouser |

(Continued)

FOREIGN PATENT DOCUMENTS

| | | | |
|---|---|---|---|
| FR | 1113205 | A | 10/1954 |
| WO | 91/04924 | A1 | 4/1991 |

*Primary Examiner* — Jacob K Ackun

(74) *Attorney, Agent, or Firm* — McNees Wallace & Nurick LLC

(57) ABSTRACT

A storage case has a rectangular base, side walls and front and rear walls upstanding from the base, and a top wall. The front wall has a lower half fixed to the base and side walls, and an upper half hinged by a hinge arrangement to the lower half. The upper half forms a door allowing access to the interior of the case. The top wall is integral with the upper half of the front wall. A drawer unit is in the door. The drawer unit has a compartment formed by the top wall, the front wall, a wall parallel to the top wall and compartment side walls.

22 Claims, 15 Drawing Sheets

(56) References Cited

U.S. PATENT DOCUMENTS

| | | | | |
|---|---|---|---|---|
| 4,129,346 | A * | 12/1978 | Hofman | A45C 5/00 312/244 |
| 5,649,658 | A | 7/1997 | Hoffman et al. | |
| 7,222,705 | B1 | 5/2007 | Guza | |
| 2002/0134697 | A1* | 9/2002 | Barnett | A45C 13/02 206/320 |
| 2004/0026294 | A1* | 2/2004 | Platte, III | A45C 5/065 206/575 |
| 2004/0031702 | A1 | 2/2004 | Mangano | |
| 2007/0221524 | A1* | 9/2007 | Brown | B65D 25/10 206/423 |
| 2008/0251341 | A1 | 10/2008 | Murdoch et al. | |
| 2012/0228074 | A1 | 9/2012 | Osler | |

* cited by examiner

FIG. 15
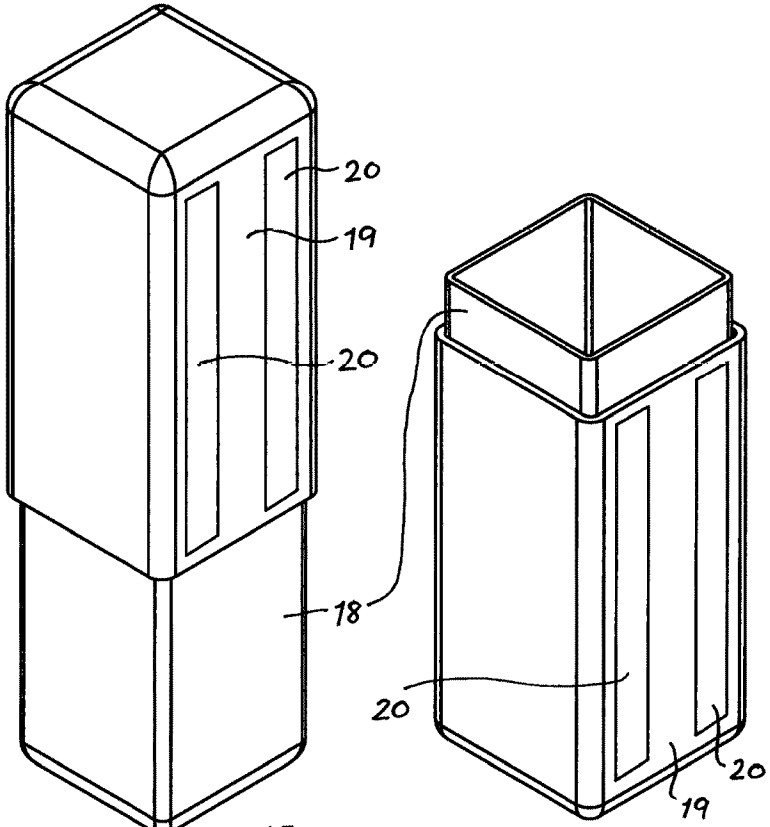
FIG. 16
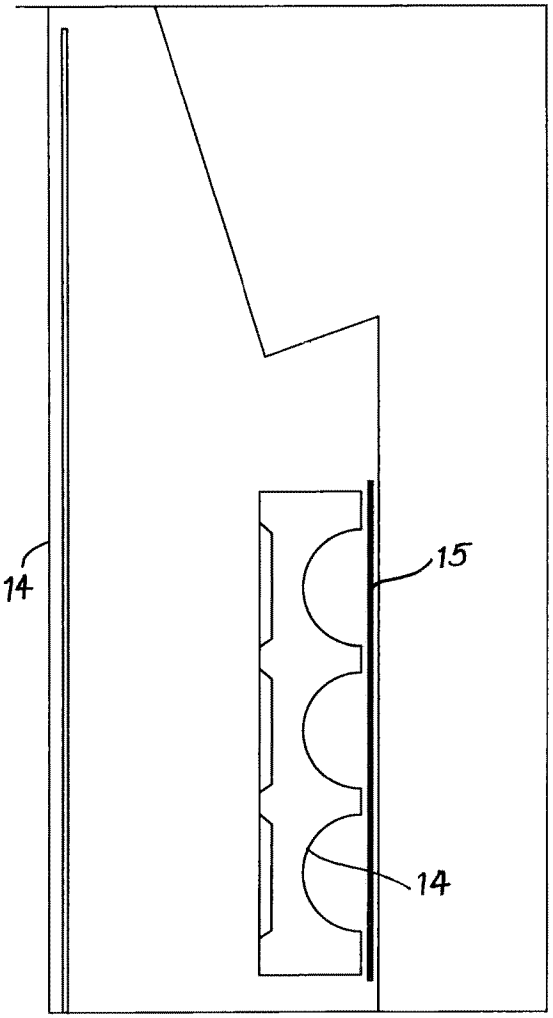
FIG. 14

STORAGE CASE

The present invention relates to a storage case, and particularly but exclusively to a portable storage case for storing craft materials.

BACKGROUND TO THE INVENTION

There is some difficulty in storage a large amount of combination of different sized items, in particular long thin items and smaller chunkier ones, such that when the user needs to retrieve these items, that they are easy to access (within arms reach) and are at the same time easily visible. This is particularly relevant for children as they have shorter arms and need to be able to reach items.

There is also some difficulty in storing a variety of different sized items in a compact form.

Conventional storage means include pencil cases, boxes, desk organisers (a so called "desk tidy") and toolboxes. The problem with pencil cases is that they only hold a limited amount of items due to their size. There is also the problem of items getting mixed up due to the lack of a dividing system. There is also the problem of quickly retrieving the item from a pencil case, as there is some going through of the various items before finding the one needed. The same problems are experienced with a simple box.

With desk organisers that have containers that hold larger, longer items at the back and smaller items in the front (so that they are visible and accessible), there is the problem of the desk organiser not having a lid. The nature of the desk organiser is such that one permanently keeps the desk organiser on the desk. However, what happens when there is a shortage of space on the desk and/or it is more desirable, for reasons such as aesthetics and the need for space on the desk, to put the desk organiser away? And what occurs if one desires to transport the desk organiser? The answers are that it is not possible to easily store a desk organiser in a drawer or cupboard (due to its chunky size as well as the height of the desk organiser) and it is equally hard to transport a desk organiser, as items will easily fall out due to the lack of a lid.

A product on the market that serves the needs for compact storage with a variety of different shaped items and having a lid to secure the items is a toolbox. The problem with this is that once the toolbox is opened up it takes up a large amount of space, as the width of the box increases. It is then hard to reach items that are furthest away.

With smaller, simple storage boxes where the width does not increase or is not naturally wide to start with, there is the issue of this type of box not being able to store a large amount of items.

With a box that has a longer length so as to store more items, one then has the issue/problem of storing a larger box. The storage is no longer compact.

When taking a child on a long journey, it is common to bring pens, pencils, paper and other craft materials in order to keep the child occupied. However, it can be difficult to keep these craft materials organised in transit. This is especially the case where the materials have to be packed away into a bag at very short notice, for example, when disembarking from a train.

Desk organisers are unsuitable for transporting items on the move since items will only be retained within the desk organiser when it is placed on a flat surface, the correct way up. When preparing for a trip, it is therefore necessary to remove pens and pencils from a desk tidy, and place them in, for example, a pencil case. Upon return, the pens and pencils must be removed from the pencil case and reorganised in the desk tidy.

A further problem with drawing and craft activities on the move is that a good working surface is often not available. Sometimes, tables are provided on seat backs, for example on trains and aeroplanes. However, these tables are generally primarily designed for holding food and drink. They often have a rough surface, and may include an indent for holding a drink. This makes such tables unsuitable for use as a working surface for drawing and other crafts.

It is well known to use a hardback book or other stiff board to rest on when drawing. This allows for drawing when no table is available, or when the surface of the table is unsuitable due to its roughness. However, carrying such a board is a significant encumbrance. If folded, it will no longer provide a smoother working surface and, if unfolded, it is not easily transportable.

It is an object of aspects of the present invention to reduce or substantially obviate the above mentioned problems.

STATEMENT OF INVENTION

According to an aspect of the present invention, there is provided a storage case having a rectangular base, side walls and front and rear walls upstanding from the base, and a top wall, wherein the front wall has a lower half fixed to the base and side walls and an upper half, at least a major section of the top wall being integral with the upper half of the front wall, the upper half of the front wall being movable between a closed position and a fully open position in which it is folded down over the lower half of the front wall, the top wall being substantially co-planar with the base when in the fully open position; and a carrying handle, said carrying handle being rigid and slidable in channels provided in the rear wall and/or the side walls of said storage case between a retracted position in which an upper edge of said handle is substantially co-planar with said top wall and an extended position in which the upper edge extends beyond the top wall and the handle can be used for carrying the case.

In one exemplary embodiment, the handle may comprise a substantially rectangular panel and said rear wall is provided with a recess having opposing side edges, wherein the side edges of said rectangular panel slidably engage with respective side edges of said recess, in use, to enable said handle to slide within said recess between said extended and retracted positions. Optionally, when said handle is in said retracted position, it is located within said recess such that its rear surface is co-planar with the outer surface of the rear wall. The side edges of said recess may comprise rails along at least a portion of the length thereof, and the side edges of the panel have respective grooves therein along at least a portion of their length, wherein the grooves and rails slidably engage with each other, in use, to enable the handle to slide within said recess between said extended and retracted positions. A tab may be provided on the upper edge of the handle, which extends beyond the surface of the top wall when the handle is in the retracted position, to enable said handle to be pulled thereby from the retracted to the extended position. The handle may include an aperture shaped and configured to enable a user, in use, to place their fingers therethrough in order to carry the case.

In some exemplary embodiments, the storage case may comprise a drawer unit having a compartment formed by a wall section parallel with the at least major section of the top wall and compartment side walls. The compartment of the drawer unit may be formed by said wall section, said compartment side walls and a further wall section which defines the base of the compartment and is substantially parallel to, and spaced apart from, the at least major section of said top wall, such that a storage slot is defined between said further wall section and said at least major section of the top wall. The upper half of the front wall and the top wall may be integral with sections of the side walls extending upwards of a hinge arrangement, the said sections of said side walls forming the compartment side walls. The said sections of the side walls may be triangular with the apices of the triangles at the junction of the upper and lower halves of the front wall. The drawer unit may contain one or more drawers.

Exemplary embodiments of the storage case may comprise one or more storage compartments within the case. The one or more storage compartments may be spaced from the rear wall to define a further storage compartment.

The storage case may comprise one or more storage containers in the case, the storage containers being removable from the case.

In some exemplary embodiments, the handle may have a rear edge co-planar with the rear wall of the case, and the top wall may optionally be recessed to accommodate the handle in its retracted position.

The storage case may comprise attachment means for attaching items to the exterior of the case, which may comprise one or more magnets. One or more walls of the case may be of, or include, magnetic material.

The storage case may optionally further comprise a mat removably attached to the case by the attachment means. Indeed, a mat may be removably attached to attachment means provided adjacent said storage slot referred to above. Alternatively, the mat may be attached to the rear wall of the storage case. The mat may comprise a first section attached to the back wall of the case and a second section attached to the base of the case, the two sections being connected. The two sections of the mat may be connected by a hinge, and the hinge may optionally be covered by a flexible sheet. The mat may be of silicone.

Exemplary embodiments of the invention may further comprise a secondary storage unit removably attached to an exterior wall of the storage case by cooperative attachment means, which cooperative attachment means may comprise magnets provided on an exterior wall of said storage case and on an exterior wall of said secondary storage unit. The secondary storage unit comprises a receptacle and a lid, wherein said attachment means is provided on said lid. The receptacle and said lid may be configured such that the receptacle can be held in an open configuration within said lid.

Embodiments of the storage case may comprise a transparent panel on said upper section of said front wall.

Another aspect of the present invention extends to a secondary storage unit for use with a storage case as defined above, comprising a receptacle and a lid, wherein attachment means are provided on the lid to enable said secondary storage unit to be attached via cooperative attachment means to an exterior wall of said storage case.

Yet another aspect of the present invention extends to two storage cases, each as defined above, a rear surface of one being removably fixed to a rear surface of the other by attachment means. The attachment means may be provided on the rear surface of the handle of each respective storage case. The attachment means may alternatively or in addition be provided on the rear wall of each respective storage case. The attachment means may comprise one or more magnets.

DESCRIPTION OF THE DRAWINGS

For a better understanding of the present invention and to show more clearly how it may be carried into effect, reference will now be made, by way of example only, to the accompanying drawings, in which:

FIG. 5 shows a perspective view of two storage cases, in their opened position, the backs attaching to one another by means of the attachment means (11*b*) by;

FIG. 14 shows the hinge arrangement (14) in a close up view, with a flexible material (15) covering the hinge so as to avoid an uneven surface when the mat is unfolded;

FIG. 15 shows a secondary storage case (18) with a lid (19). The lid of the secondary storage case in this example has attachment means (20) on at least one side;

FIG. 16 shows how the container fits into the lid in a snug fashion;

DETAILED DESCRIPTION

A first exemplary embodiment of the storage case is described in the following description in its orientation of normal use as shown in FIGS. 1 to 17.

1. The Main Unit

Figure 2:
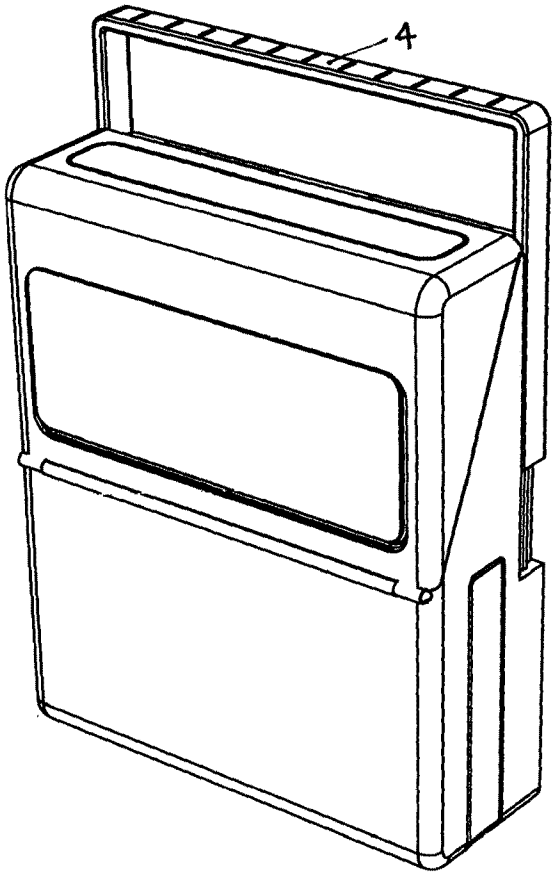
FIG. 2 shows the storage case of FIG. 1, the rigid handle (4) extended in a position for carrying.
Figure 1:
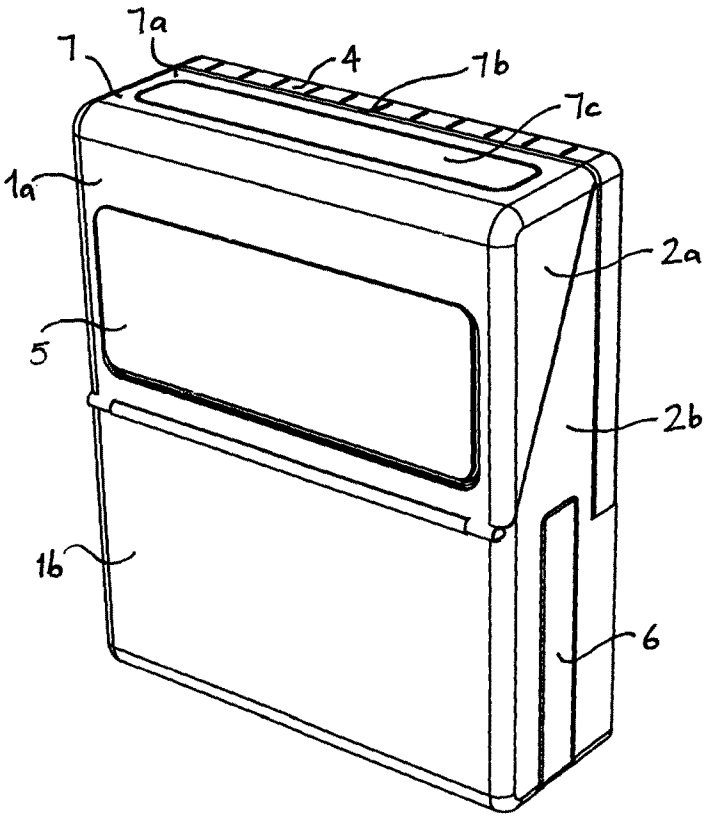
FIG. 1 shows a perspective view of a storage case according to an exemplary embodiment of the invention. The storage case is shown in its closed, upright position, with a rigid handle (4) retracted.
Figure 3:
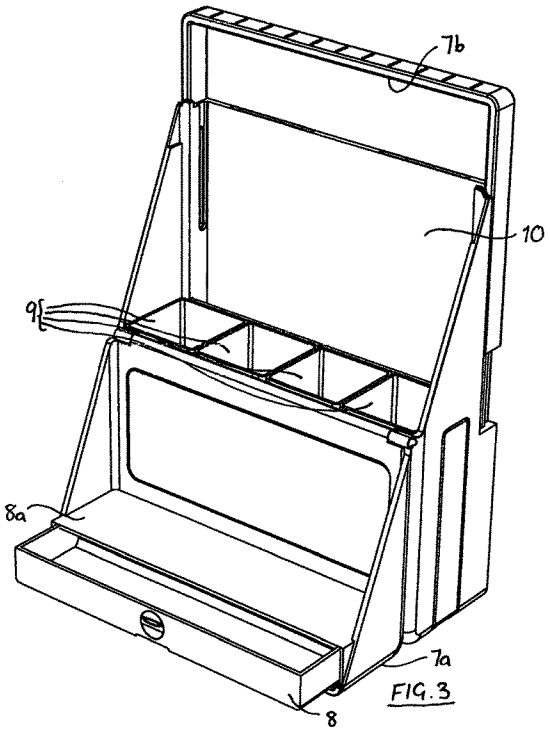
FIG. 3 shows a perspective view of the storage case opened, revealing a drawer unit (8), which is an open position.

The storage case shown in FIGS. 1, 2 and 3 is generally a rectangular box having a front wall 1, a rear wall 11, side walls 2 (only one shown) which are narrow compared to the front and rear walls, a base and a top wall 7. The front 1, rear 11 and side walls 2 upstand from the base. The side walls are rectangular being longer in the vertical direction than in the horizontal width direction. The top wall and base are rectangular, the width of each being equal to the width of the side walls. The front and rear walls are also rectangular, the vertical height of the front and rear walls being greater than the horizontal width.

Illustrative Dimensions

One example of the storage case is 182 mm wide, 220 mm high and 65 mm deep.

Material

One example of the storage case is of plastic. It may be of moulded sections.

Other examples may be of any suitable material.

The front wall 1 is divided into two equal halves; a lower half 1*b* and an upper half 1*a*. The upper half 1*a* is integral with a major section 7*a* of the top wall 7 and sections 2*a* of the side walls. The side wall sections 2*a* in the example are triangular and as shown extend from the lower edge of the upper half of the front wall to the rear of the major section 7*a* of the top wall. The upper half 1*a* of the front wall together with the side wall sections 2*a* and the major section 7*a* of the top wall form a door of the case. In the example shown in FIGS. 1 and 2, the upper half of the front wall is hinged to the lower half of the front wall. The upper half of the front wall may be arranged to pivot about the upper edge of the lower half of the front wall by other means.

The top wall 7 is divided into the major section 7*a*, which is integral with the door, and a minor section 7*b*, which is integral with the rear wall and the fixed sections 2*b* of the side walls, which are not part of the door. The major and minor sections of the top wall attach to one another.

The minor section of the top wall and the fixed sections of the side wall which are not part of the door accommodate a carrying handle 4. The minor section of the top wall may be recessed to accommodate the handle in a retracted position.

Another possible arrangement of the top wall 7 may include the major section 7*a* which is integral with the door and then a minor section that protrudes from this major section (and therefore integral with the door too) to attach to the back wall in order to close the storage case. This protrusion is essentially a flat extension coming from underneath the drawer unit that is the same width as the handle. The handle would then rest on top of this flat extension.

The upper half 1*a* of the front wall may include a panel 5. The panel may be decorative and/or functional in that they may contain attachment means for secondary containers. The panel 5 may be a transparent panel or window 5 so that items can be viewed in the closed position of the door.

Side Walls

The fixed side wall sections 2*b* at the upper half of the storage case are triangular complementary to the triangular side wall section 2*a* forming part of the door. The triangular side wall sections allow good access to the interior of the case when the door is fully open, as opposed to a straight, rectangular shaped wall which would hinder the access to the side storage containers 9. Each fixed section of side wall 2*b* may include an attachment means.

The Door [FIG. 1 (1)]

The door includes a storage compartment or drawer unit 8. In the example shown the drawer unit comprises a drawer 8 within a compartment formed by the major section of the top wall 7, the side wall sections 2*a* and a further wall 8*a* parallel to the top wall and integral with the front and side walls. The drawer unit is moved with the door between a closed position in which the drawer unit is within the closed case, and an in-use position in which the door is fully open and the top wall, which forms the base of the drawer unit, is co-planar with the base of the case.

Different Storage Area:

When the door is opened, adjacent to the front wall of the storage case, a plurality of different storage areas are revealed (refer to FIG. 3). In this example there are three main storage areas;

a) The main storage containers (9)

One main storage area comprises one or more separate containers 9. In the figures provided, four of these containers are shown.

b) The back storage area (10)

Between this main storage area 9 and the rear wall 11 is a space 10 to store larger items such as paper or for holding further separate, thinner containers.

c) The drawer unit (8)

This is described below. The drawer unit may holder smaller items such as an eraser and sharpener. The drawer unit may contain further separate containers. There may be one or more separate drawer units in the door.

The Sidewalls and Attachment Means:

The sidewalls of the main unit may have attachment means 6. In this example, magnets in the form of panels 6 are used. Half of a panel may be split lengthwise into two different magnetic poles. Other attachment means may be used such as a groove system or clips.

The sidewalls may have panels 6 for decorative as well as recognition purposes as they could be in a different colour to the main body of the case. These panels could serve as labelling places for recognition.

The Top Wall

The top wall section 7*a* which is integral with the door may also have a panel 7*c* for decorative purposes but could also be used as a window in order to view items in the case.

All the panels 6 and 7*c* may be removable They may be replaced and exchanged.

Figure 4:
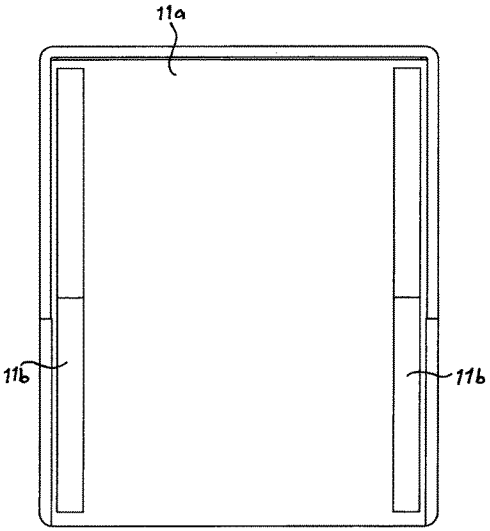
FIG. 4 shows a back view of a storage case, showing the back wall (11*a*) with attachment means (11*b*) such as magnets.

The Back Wall [FIG. 4 (11*a*)]

This has an attachment means, in this example magnets 11*b*, embedded into the wall. The configuration of the magnets is such that when another storage case attaches to it, the opposite poles attract and therefore attach to one another. Other attachment means may be used such as a groove system of clips.

The Handle 4

The rigid retractable handle 4 does not obstruct removal and attachment of the door or access to items stored within the case. The handle is preferably permanently attached to the case so that it will not become lost.

The rigid handle may be slidably mounted within channels in the sidewalls of the case. In one example, the handle retracts onto the top of the case when the handle is not in use. In another example, the top wall section beneath the handle is recessed to accommodate the handle when in its retracted position. The rear edge of the handle is preferably co-planar with the rear wall of the case. A further possibility is for an extension of the top wall 7, as described above.

The Drawer Unit 8

The storage case includes a drawer unit in the door [FIG. 3, (8)] of the storage case in such a way that the base of the drawer unit forms the top wall of the case. The drawer unit comprises a compartment for containing one or more drawers. The compartment is defined by the front wall, the top wall, a further wall parallel to the top wall and compartment side walls. In this example the compartment side walls are sections of the side walls of the case.

When the door is opened as shown in FIG. 3, the drawer unit is then in a position for its operation as a drawer and items can be accessed.

The drawer unit may have one or more drawers. The drawer (s) are sized to fit snugly within the compartment and may include releasable attachment means for temporarily fixing it within the case. The user therefore has the option to include one or more drawers or other storage units within this compartment.

Figure 5:
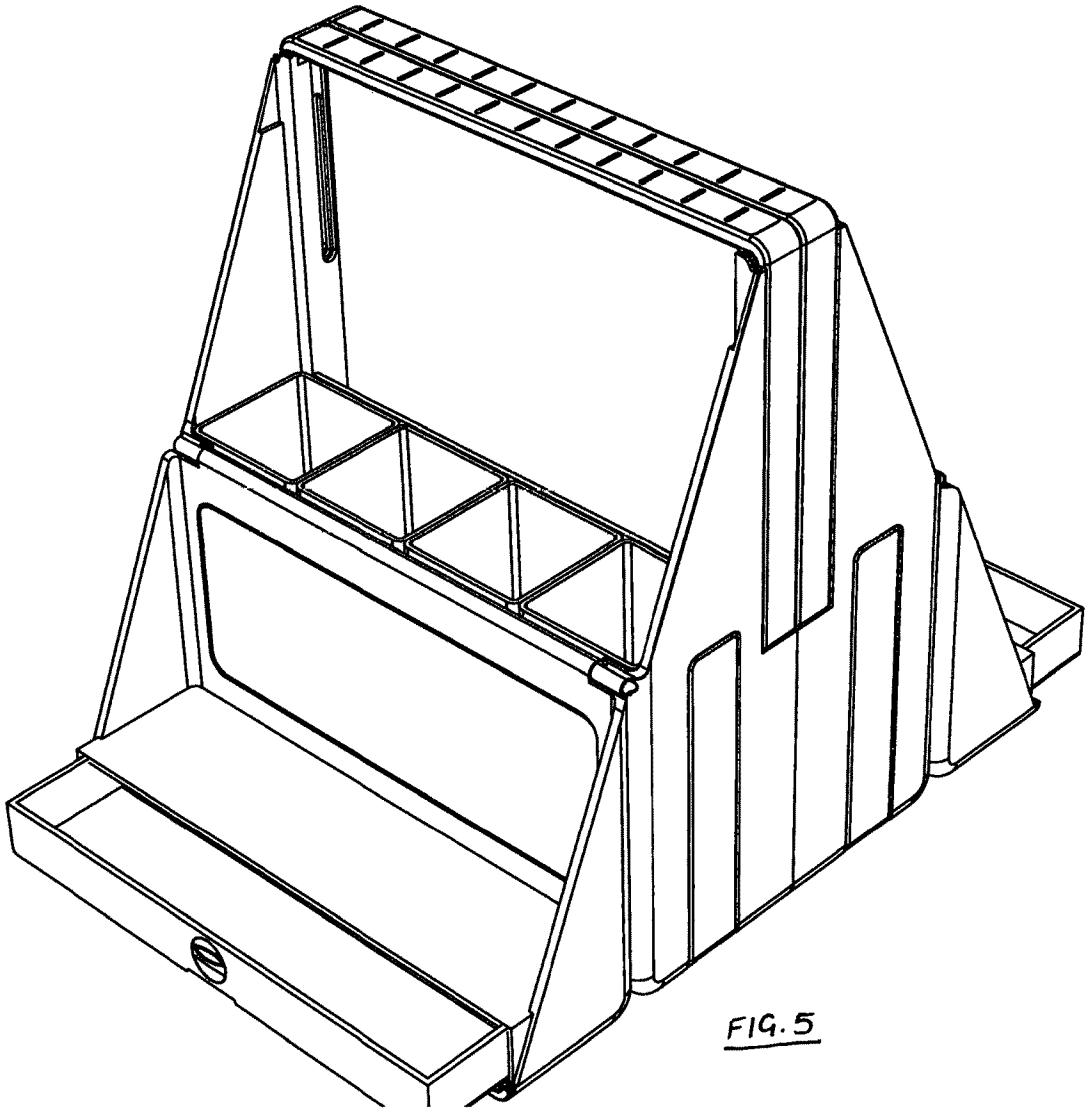
Figure 6:
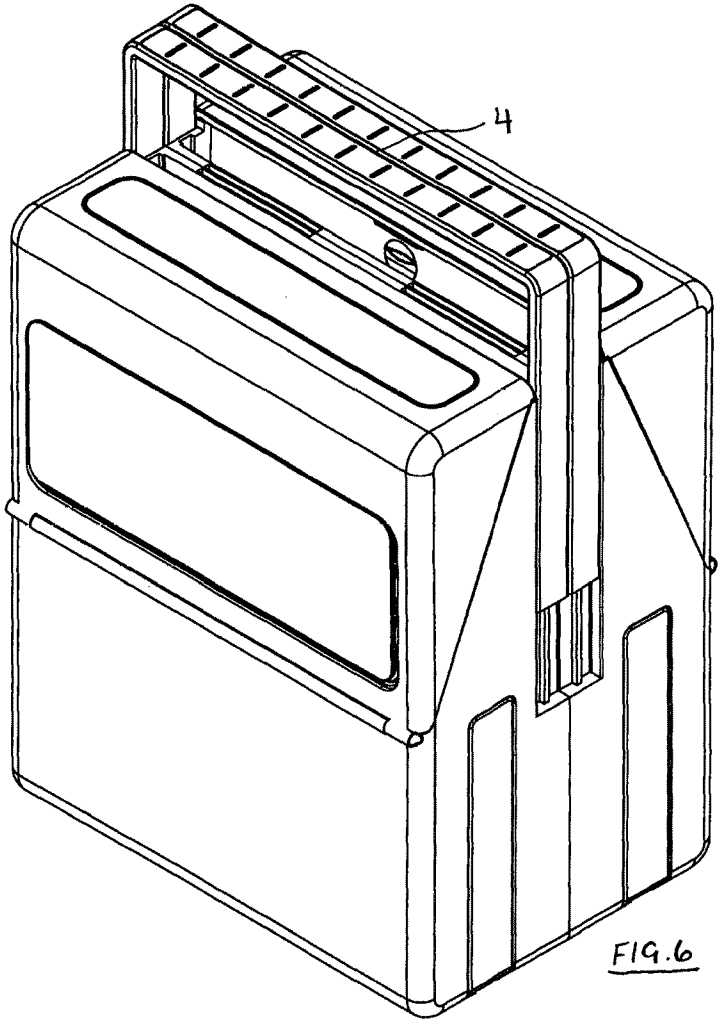
FIG. 6 shows a perspective view of two storage cases, in their closed position, the backs attaching to one another and the two handles (4) meeting one another by their side walls in order for the two storage cases to be carried as one unit.

Two Cases Back-to-Back (FIGS. 5 and 6)

As discussed above, the rear wall of a case may include attachments means for example one or more magnets. The magnets may be panels on the outer or inner surface of the rear wall or embedded in the rear wall. The attachment means may be arranged to allow two identical storage cases to be fixed together back-to-back as shown in FIGS. 5 and 6. The handles of the two cases abut if the rear edges of the handles are co-planar with the rear walls as shown in FIGS. 1 to 6.

A Mat (FIGS. 7-13)

The storage case may additionally have a mat 12. The mat preferably has a non-slip surface on the underside. The mat in this first example (FIGS. 7 and 8) has two rigid sections 12*a* and 12*b*. Section 12*a* attaches to either the back or front wall and the extended section 12*b* attaches to the base of the storage case. There is also the possibility of it attaching to the top wall of the case. Each section has its own set of attachment means (13), in this example, magnets. The extended section (12*b*) is not seen in FIG. 8 as it is underneath the storage case. It folds underneath the base of the storage case. In this example the sections 12*a* and 12*b* are joined by a hinge arrangement (14).

Figure 7:
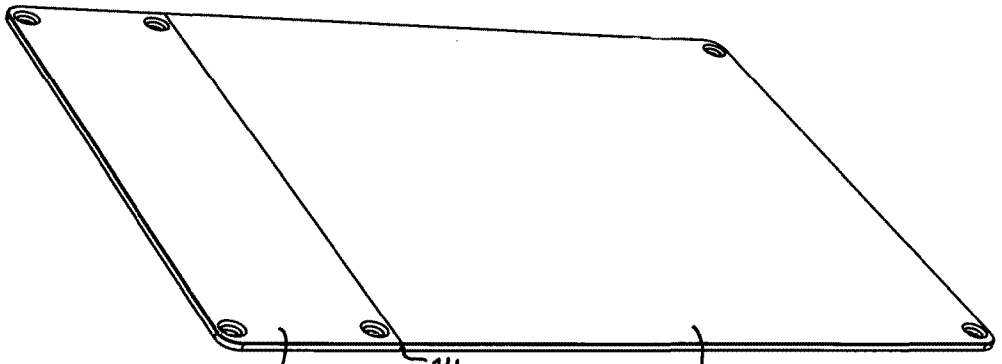
FIG. 7 shows an optional A configuration of the mat unfolded, with the extended section of the mat (12*b*), the main section (12*b*) as well as a hinge arrangement (14) lying flat.
Figure 8:
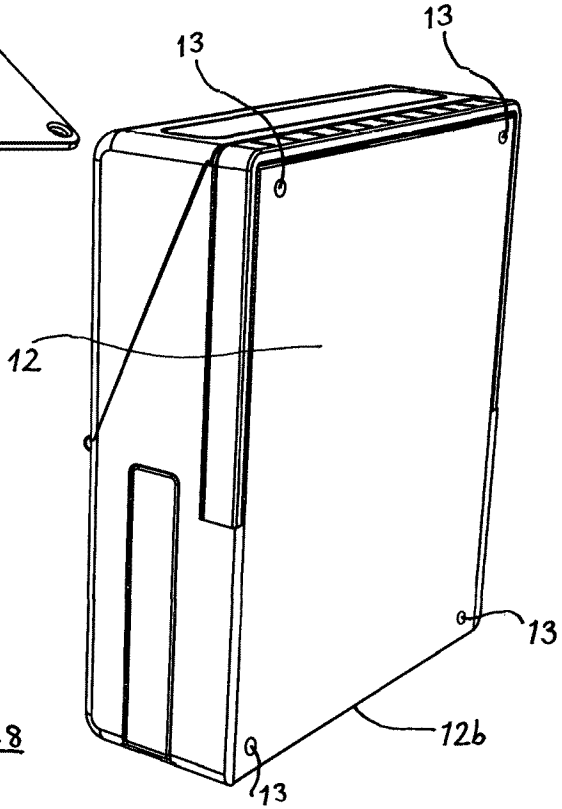
FIG. 8 shows a back view of a storage case with the main body of an optional A, mat (12*a*) attached to the back wall in this example. The mat may have an extended section (12*b*) attached to the base of the storage case. Magnets (13) in this example are the attachment means.

The mat may be moveable about the hinge arrangement between the folded condition attached to the case shown in FIG. 8 and a planar condition shown in FIG. 7.

The hinge of the mat may be a live hinge, and the hinged closure may be formed integrally in one piece. The closure, including the live hinge, may be covered by a sheet of flexible material.

The mat in use is unfolded from the storage case to provide a completely flat working surface. The mat is preferably of a flexible material which may be silicone, which is flexible and smooth, allowing it to deform in the area of the hinge when the mat is folded and unfolded.

Alternatively, the mat may be formed of planar sections, joined together at the hinge. In this case, the hinge may be made from a flexible material such as silicone. The silicone may be bonded to the planar sections, and forms a smooth but deformable area of the mat, allowing folding and unfolding. A mat having a silicone hinge may be covered by a sheet of silicone or a similar flexible material (FIG. 14).

A further alternative is that the mat is made of two rigid panels that are connected by a hinge. The hinge could be covered by a flexible material to provide a continuous surface. A material such as plastic or wood may be used.

Another possibility is for the mat to be made of fabric such as oilcloth that folds around the storage case on any number of walls.

A number of configurations to make the mat larger could be used. The first is shown in FIGS. 7 and 8 whereby an extended section of the mat attaches to the underside of the storage case.

Figure 10:
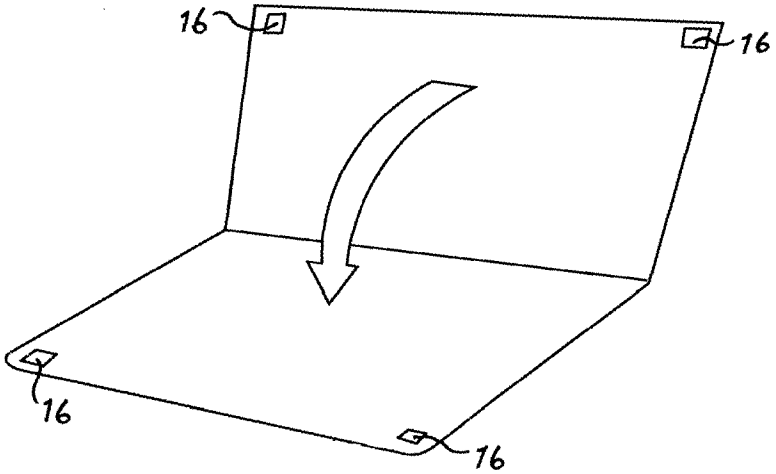
FIGS. 10 and 11 show a further configuration for the mat, so as to achieve a larger working surface whereby the mat is folded in half and joins together by its own attachment means (16) and once folded in half is able to attach to the back of the box by a further set of attachment means (17)
Figure 11:
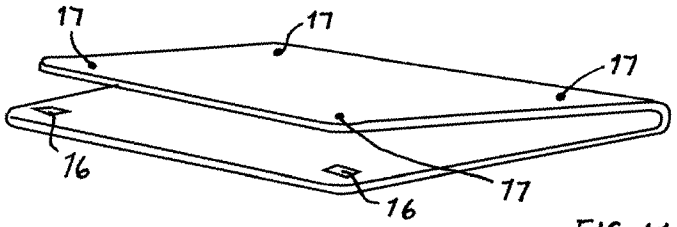
Figure 17:
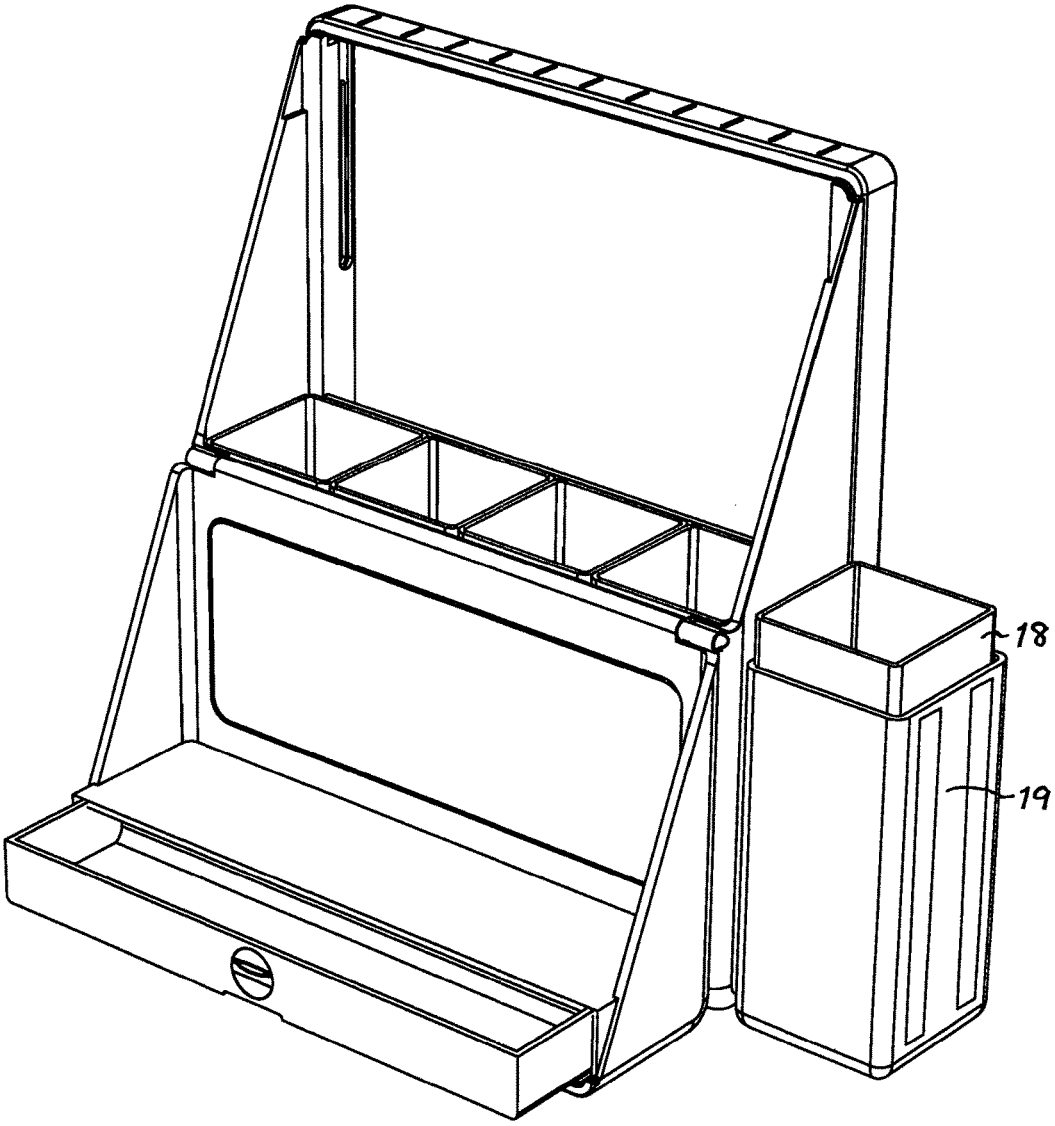
FIG. 17 shows a storage case, with a secondary storage case (18) and its lid (19) attaching to a sidewall of the storage case.

A further option is in FIGS. 10 and 11 whereby the mat may be folded in half from the planar condition, to an intermediate position in which the mat is substantially half the area and double the thickness of the mat in the planar condition. This mat would attach to the back wall of the storage case.

Figure 12:
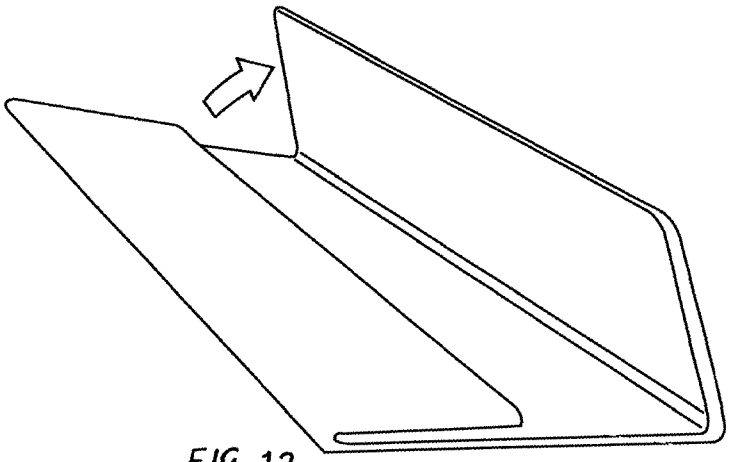
FIGS. 12 and 13 show a further configuration for the mat where two opposite sides fold in to meet in the middle.
Figure 13:
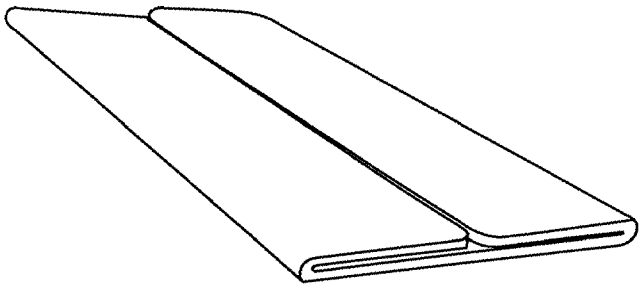

FIGS. 12 and 13 show a further arrangement of hinges such as that two of the outer edges of the mat meet in the centre of the mat. This configuration would attach as in FIGS. 10 and 11.

The hinges referred to may both be live hinges, may both be silicone hinges, or may be one of each type of hinge as described above.

These mat configurations in FIGS. 10, 11, 12 and 13 all have attachment means for holding them closed.

Holding means may be provided for retaining the mat to the case. The holding means may include a magnet. A magnet or ferrous component may be imbedded in the mat, without having any impact on the smoothness of the surface. This is advantageous over surface-mounted holding means such as hook and loop fasteners, which necessarily involve disruption to a smooth surface.

A corresponding magnet or ferrous component may be imbedded in, or mounted to, at least one side of the case.

Figure 9:
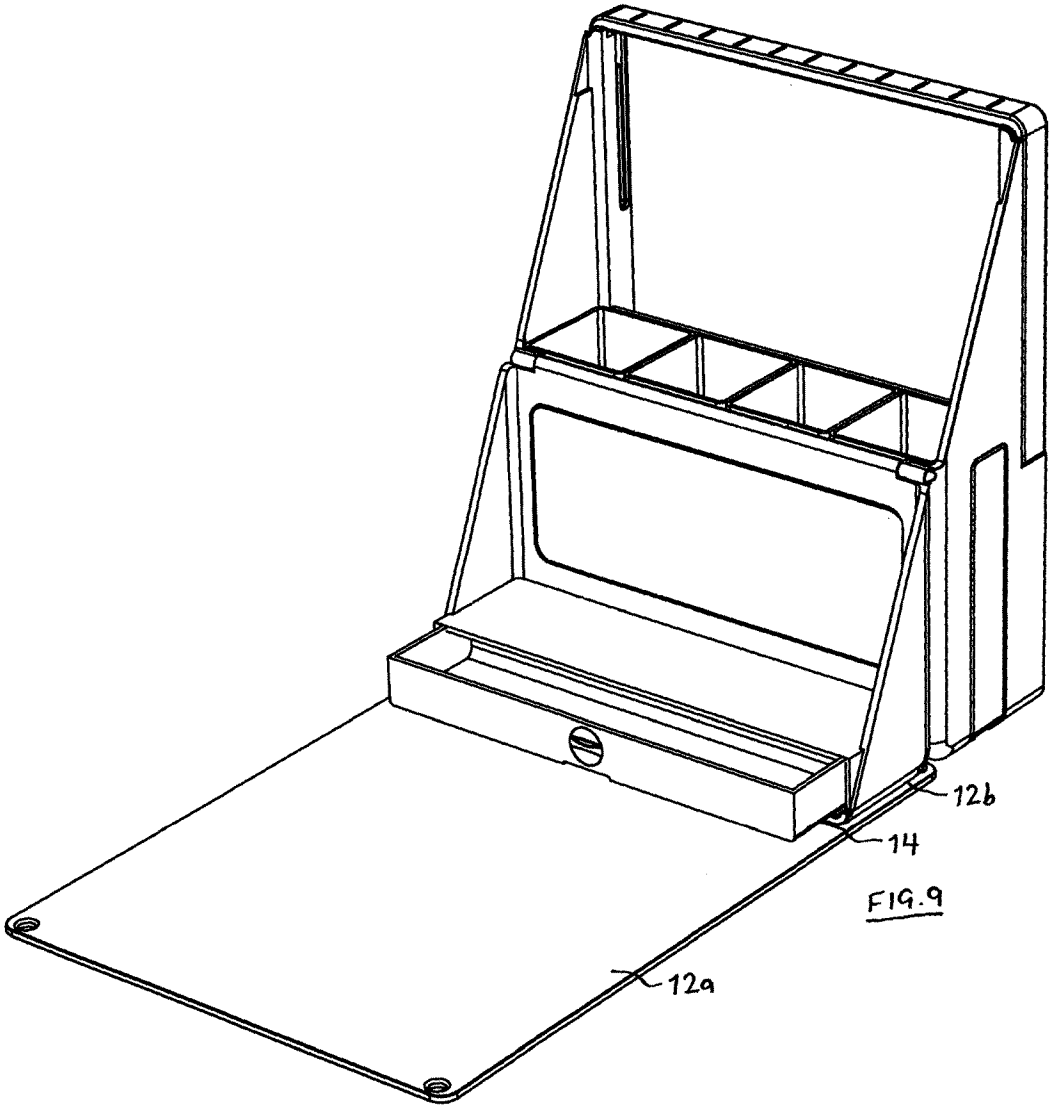
FIG. 9 shows a perspective view of an opened storage case attached to the mat (12*a*) such that the storage case and the mat are one unit. The extended section of the mat (12*b*) is attached to the underneath of the storage case.

The attachment means on the mat attach to the attachment means on the base of the storage case, making the mat and the storage case one unit (FIG. 9). The one side of the mat could have a slip resistant surface so that when the storage case was in its open position and work was carried out on the mat, it would to a large degree prevent the whole unit from being displaced/falling over.

The mat could be made from any suitable material. What would be most preferable is a type of silicone that is still enough so as to provide a rigid surface to work on. This would be ideal for when on the move. And silicone would work well with the hinge arrangement. Another option is to have a mixed material made up of magnetic pieces and silicone/plastic to create a magnetic plastic/silicone.

The particular arrangement of the mat in FIGS. 7 and 8 in which the mat attaches to two surfaces of the storage case requires further discussion: Even if the hinge arrangement used does not provide for continuous surface on the mat it will not impede the working surface. This is because the base of the storage case will attach onto the mat on section 12*a*, leaving the remaining 12*b* section exposed and therefore free of hinges. See FIG. 14.

Secondary Containers (FIGS. 15 to 18)

Releasable attachment means may be provided on an outer surface of at least one side of the case, for the attachment of one or more secondary storage containers.

Releasable attachment means may be additionally or alternatively provided on an interior surface of the case. For example, releasable attachment means may be provided on an interior surface of the closure wall or the drawer unit.

A secondary container may be included, the secondary container being sized to fit within the storage case, the secondary container being removable from the storage case, and releasable attachment means being provided for attaching the secondary container to an exterior surface of the storage case. The secondary containers may be the same size as the containers 9 in the case or they may be double, triple or quadruple the size. Essentially they are interchangeable with any number of the containers 9 in the case. The secondary containers have lids so as to secure the items being held.

A second exemplary embodiment of the storage case is described in the following description in the orientation of normal use as shown in FIGS. 18 to 25.

Main Unit

Figure 19:
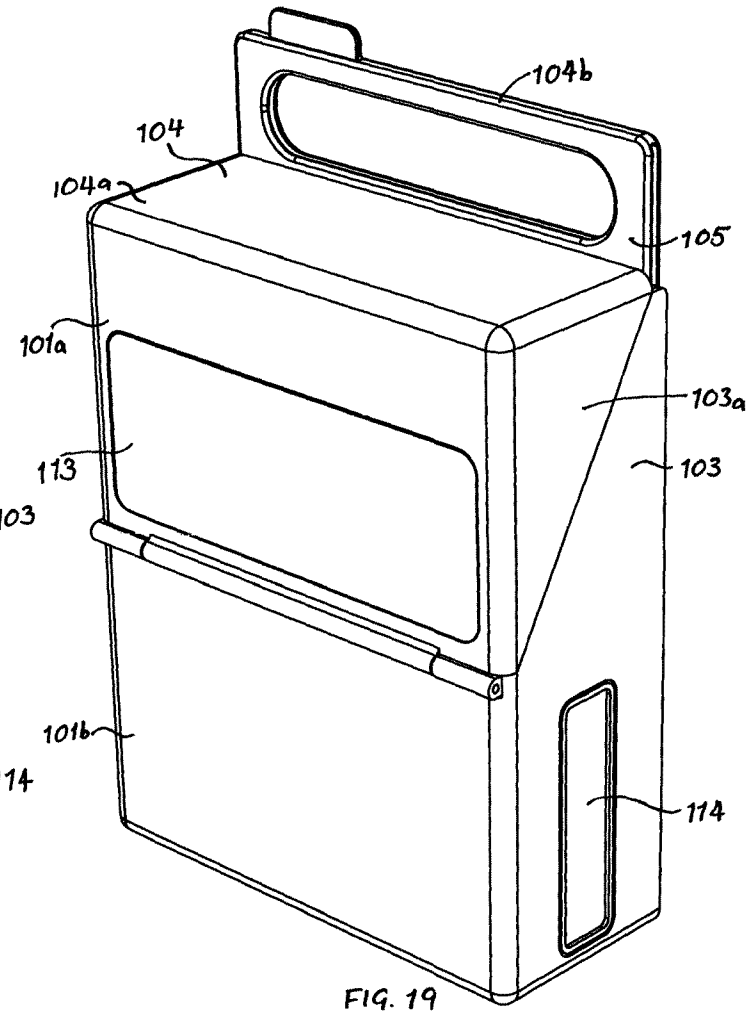
FIG. 19 is a schematic side perspective view of the storage case of FIG. 18, with the door in the closed configuration and the handle extended.
Figure 18:
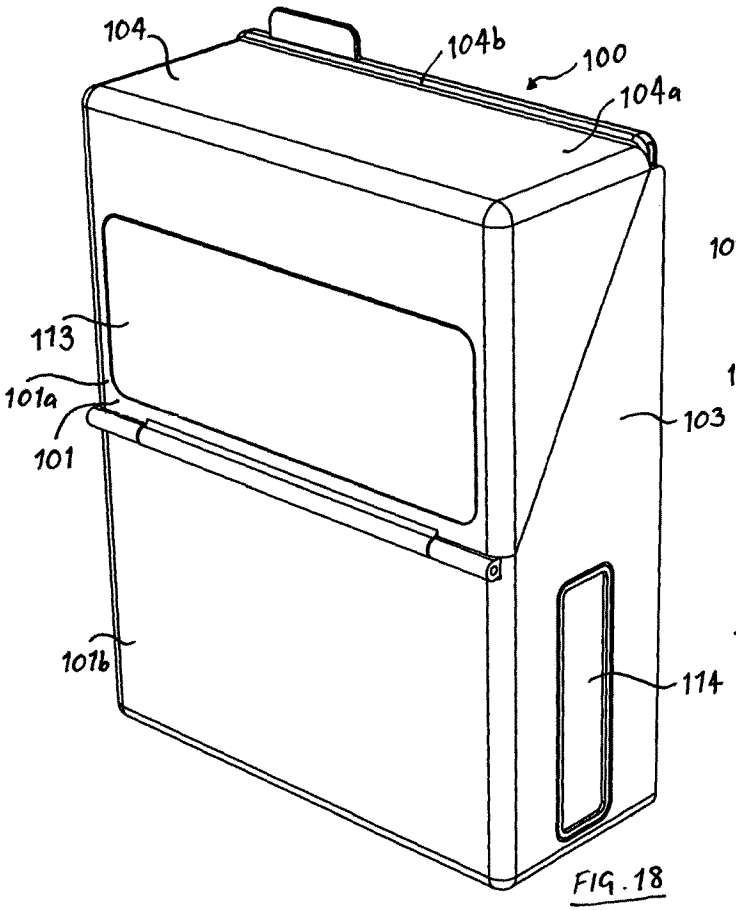
FIG. 18 is a schematic side perspective view of a storage case according to another exemplary embodiment of the present invention, with the door in the closed configuration and the handle retracted.
Figure 20:
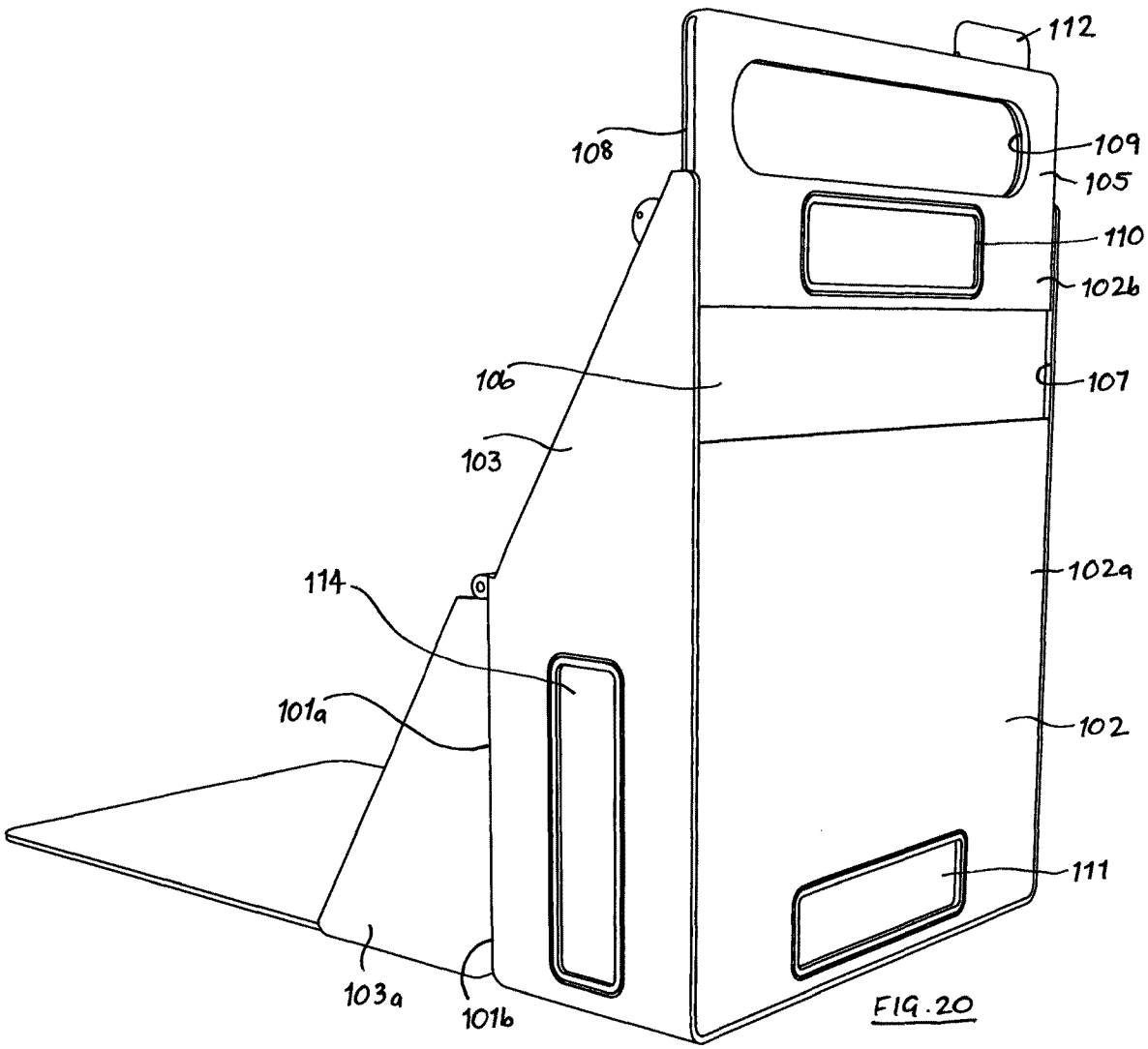
FIG. 20 is a rear perspective view of the storage case of FIG. 19, with the door in the open configuration and the mat attached and extended.

The storage case shown in FIGS. 18, 19 and 20 is, once again, a generally rectangular box 100 having a front wall 101, a rear wall 102 and side walls 103 (only one shown) which are narrow compared to the front and rear walls, a base and a top wall 104. The front 101, rear 102 and side walls 103 are upstanding from the base. The side walls 103 are rectangular, being longer in the vertical direction than in the horizontal width direction. The top wall and base are rectangular, the width of each being equal to the width of the side walls. The front and rear walls are also rectangular, the vertical height of the front and rear walls being greater than the horizontal width.

The illustrative dimensions and material(s) may be similar to those exemplified in relation to the first described embodiment, but the present invention is not necessarily intended to be limited in this regard.

The front wall 101 is divided into two substantially equal halves: a lower half 101*b* and an upper half 101*a*. The upper half 101*a* is integral with a major section 104*a* of the top wall 104 and sections 103*a* of the side walls. The side wall sections 103*a* in the example are triangular and as shown extend from the lower edge of the upper half of the front wall to the rear of the major section 104*a* of the top wall. The upper half 101*a* of the front wall, together with the side wall sections 103*a* and the major section 104*a* of the top wall form a door of the case 100. In the example shown, the upper half 101*a* of the front wall is hinged to the lower half 101*b* of the front wall. The upper half 101*a* of the front wall may be arranged to pivot about the upper edge of the lower half 101*b* of the front wall by other means.

The top wall 104 is divided into the major section 104*a*, which is integral with the door, and a minor section 104*b* which is actually the upper edge of a carrying handle 105. Indeed, and referring specifically to FIG. 20 of the drawings, the rear wall 102 is effectively formed of two sections, a major section 102*a* and a section 102*b* which is actually the rear face of the handle 105. A recess 106 is provided at the upper edge of the rear wall 102 having opposing side rails 106, within which recess 106 the handle 105 is able to slide up and down between a stored configuration (shown in FIG. 18) and a carrying configuration (shown in FIGS. 19 and 20), and opposing grooves 108 are provided in the side edges of the handle to engage with the rails 107 in the recess 106 to facilitate this sliding operation.

An opening 109 is provided in the handle 105, to enable a user to insert their hand and facilitate carrying of the storage box. A magnetic strip 110 is provided on the handle 105, to enable an identical storage box to be affixed thereto, in a back-to-back orientation, such that two connected storage boxes can be used (in the open configuration) and carried together (in a closed configuration, with the two handles 105 of two connected boxes together effectively forming a single handle. In order to facilitate the extension of the two handles, when two storage boxes are connected together in this manner, an upstanding tab 112 is provided, which extends above the top wall 104 of the storage box when it is in its closed configuration and enables a user to extend the handles of two connected boxes by simply pulling the tab 112 upwardly. A further magnetic strip 111 may be provided at the lower edge of the rear wall 102 to further strengthen the connection between two back-to-back storage boxes.

Further magnetic strips 114 may be provided on one or both side walls 103 to enable other containers to be attached to the box, as will be described in more detail later.

Referring back to FIGS. 18 and 19 of the drawings, the upper half 101*a* of the front wall may include a panel 113. The panel may be decorative and/or functional in that it may contain attachment means for secondary containers. The panel 113 may be a transparent panel or window so that items can be viewed when the door is in the closed configuration.

It can be seen from FIG. 20 that, in this exemplary embodiment of the present invention, the profile of the upper edge of the side walls matches the profile of the hypotenuse of the triangular section 103 forming the side of the door. Thus, as shown in FIGS. 18 and 19, when the door is in the closed configuration, the hypotenuse edges of the hypotenuse edges of the triangular sections 103*a* thereof abut the angled upper edges of the side wall 103.

Figure 21:
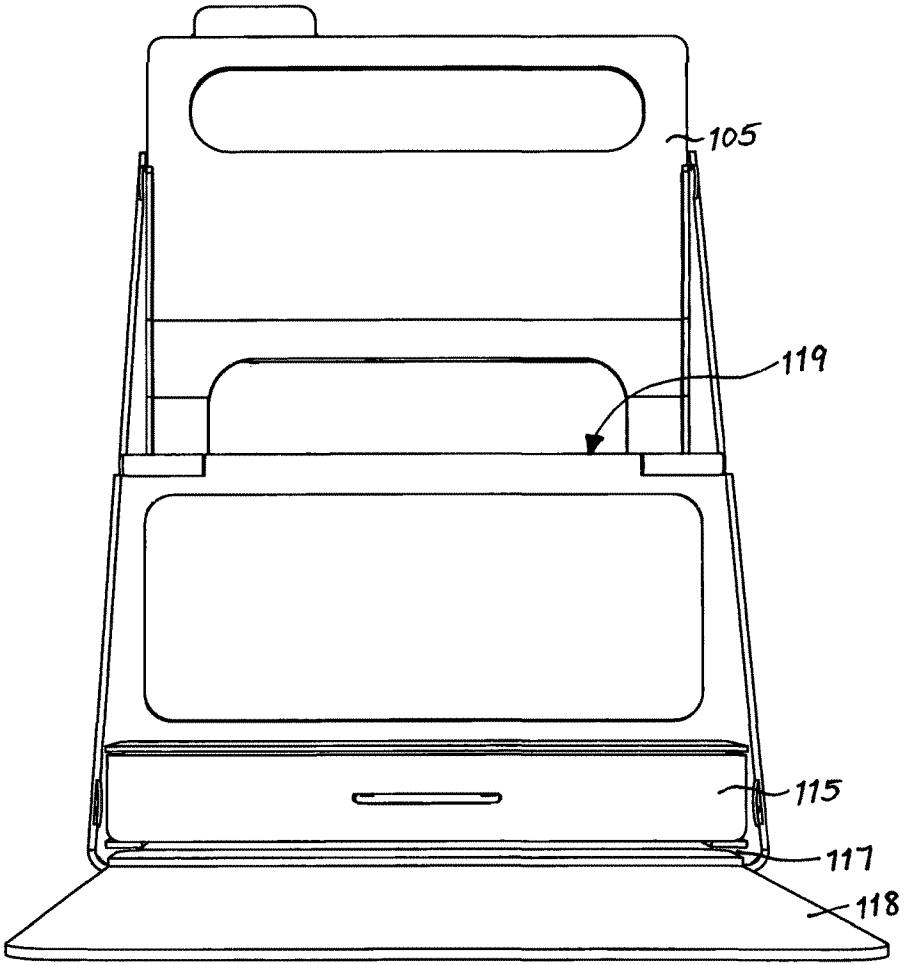
FIG. 21 is a front view of the storage case of FIG. 20.
Figure 22:
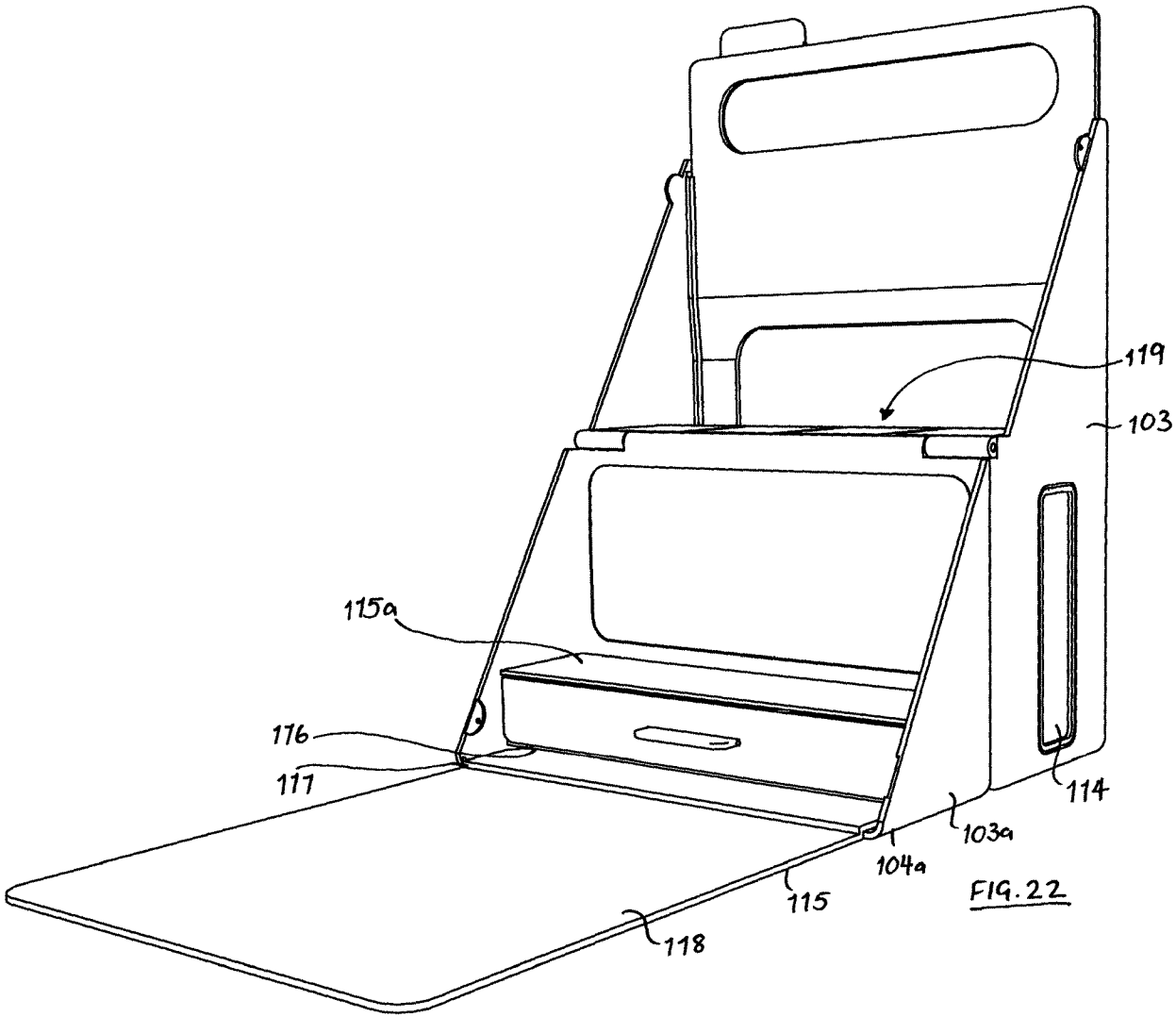
FIG. 22 is a partial side perspective view of the storage case of FIG. 20.
Figure 23:
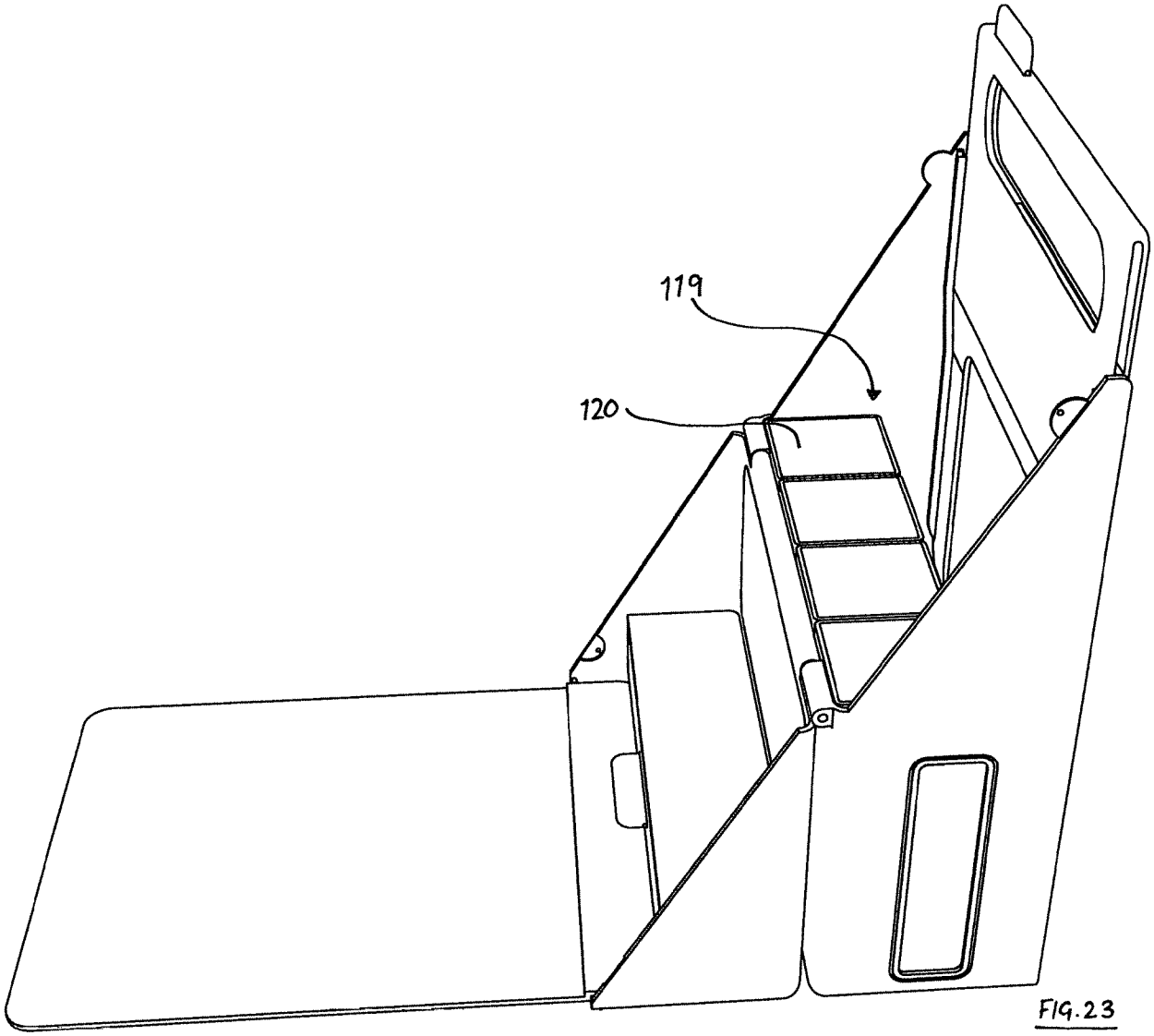
FIG. 23 is a side perspective view of the storage case of FIG. 20.

Referring to FIGS. 21 and 22 of the drawings, the door includes a storage compartment or drawer unit 115. In the example shown, the drawer unit 115 comprises a drawer within a compartment formed by a base which is substantially parallel to, and spaced apart from, the major section 104*a* of the top wall, the side wall sections 103*a* and a further wall 115*a* substantially parallel to the top wall 104 and integral with the front and side walls. Thus, it can be seen that a space 116 is provided between the base of the drawer unit and the inner surface of the top wall 104 to accommodate a magnetic strip 117 to which a mat 118 can be removably attached. The space 116 may additionally be wide enough to accommodate a computing device such as a tablet or the like. The drawer unit 115 is moved with the door between a closed position in which the drawer unit is within the closed case, and an in-use position in which the door is fully open and the top wall 104 is co-planar with the base of the case. It can be seen that, by providing the drawer unit 115 entirely in the door portion, the major storage portion 119 of the storage box is unobstructed thereby.

As previously stated, the side walls 103 of the main unit have attachment means, possibly in the form of magnetic strips or panels 114. Half a panel may be split lengthwise into two different magnetic poles. Other attachment means may be used such as a groove system or clips. Once again, the panels 115 may be for decorative as well as functional purpose.

As discussed above, the rear wall 102 of the storage case and the rear surface of the handle 105 may be provided with magnetic strips or panels 110, 111, which may be provided on the outer surfaces of the wall and handle, or may be embedded therein. These magnetic panels are configured to allow two identical storage cases to be fixed together back-to-back, such that the rear surfaces of the two handles abut. Alternative attachment means for this purpose are envisaged, including a groove system or clips.

As previously stated, the storage case may include a mat 118. The mat may have a non-slip surface, and may be configured as in the previously described example.

Secondary Containers

As previously stated, releasable attachment means 114 may be provided on an outer surface of at least one side of the case, for the attachment of one or more secondary storage containers. One or more secondary containers 120 may be included, each secondary container 120 being sized to fit within the storage case, the secondary container being removable from the storage case, and releasable attachment means being provided for attaching the secondary container 120 to an exterior surface of the storage case.

Figure 25:
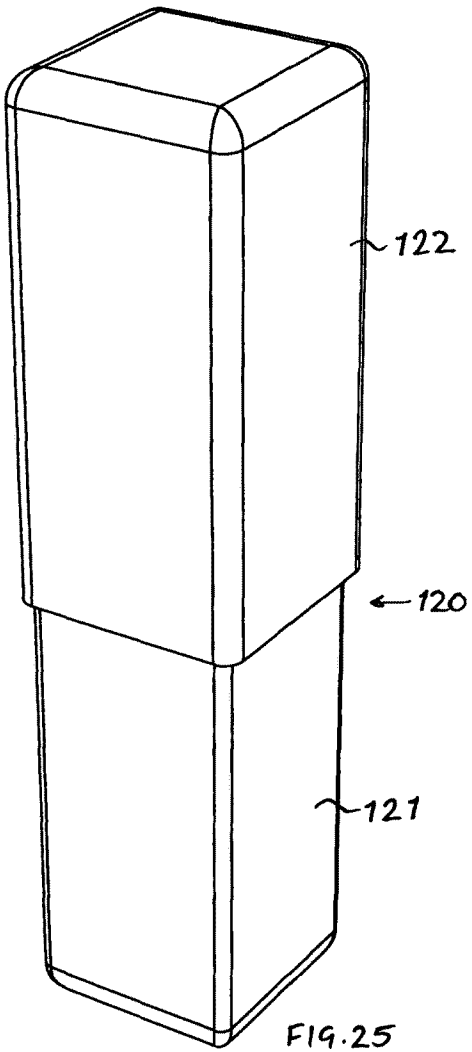
FIG. 25 is a perspective view of the storage container of FIG. 24 in an alternative closed configuration.
Figure 24:
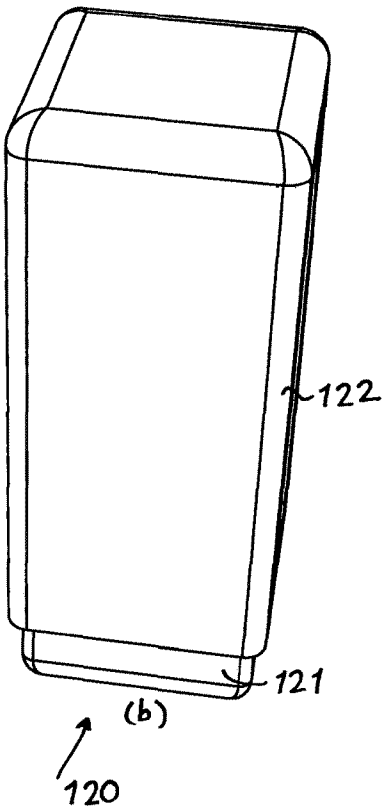
FIG. 24 is a perspective view of exemplary storage containers in an (a) open configuration and (b) closed configuration.
Figure 24:
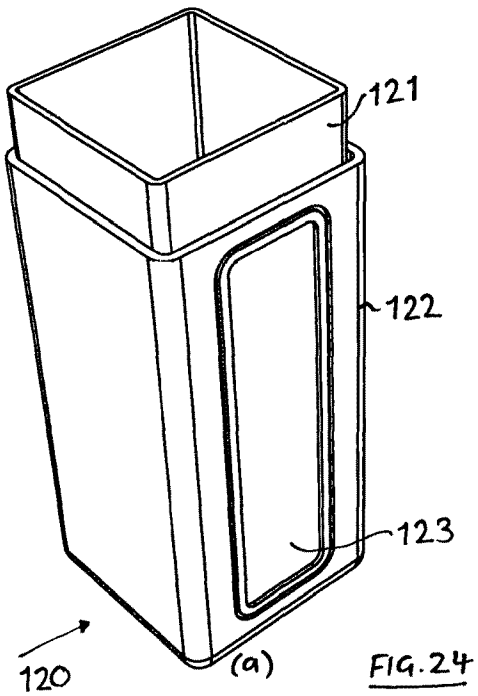

Referring to FIGS. 24 and 25 of the drawings, each secondary container 120 may comprise a generally rectangular receptacle 121 and a generally rectangular lid 122, which may be of clear plastic in order to allow a user to see the contents of the receptacle, when the container is in the closed configuration shown in FIG. 24(*b*) and FIG. 25. A magnetic strip 123, or other releasable attachment means, is provided on a side wall of the lid 122. The lid and receptacle may be configured such that the lid may be used to cover the receptacle in two different ways. A first manner is shown in FIG. 24(*b*) in which the lid 122 extends substantially all of the way down the length of the outer edges of the receptacle, such that the base of the lid is adjacent the receptacle opening. For storing longer items, the lid and receptacle may be configured such that if the orientation of the lid is turned through 90°, it abuts an edge of the receptacle and is prevented from moving all the way down its length, leaving a space at the top sufficient to accommodate longer items in the receptacle, as shown in FIG. 25. It can be seen in FIG. 24(*a*) that the receptacle 121 and lid 122 are configured such that the receptacle 121 can be held in an open configuration within the lid 122 when the container is in use, and by placing the attachment means 123 on a side wall of the lid, the container can be attached to the main unit in this configuration for use.

Providing a portable case with removable secondary containers which are attachable to the outside of the case combines the advantages of a desk tidy with the advantages of a portable stationery box. Pens, pencils and other craft items may be stored in the secondary containers, and the secondary containers may in turn be placed within the closable main case for transportation (in exchange for others already in the storage case), depending on the needs of the user.

Various personal configurations can be achieved by the attachment of any number of secondary personal containers.

When work is to be done, the secondary containers may be removed from within the main case and/or separate secondary containers can be obtained and attached to the outer surface of the main case in a convenient configuration, creating a desk tidy.

The releasable attachment means may comprise a dovetail slot, top-hat slot or the like on the exterior surface of the main case and a corresponding protrusion such as a dovetail from an exterior surface of the secondary container. Alternatively, an undercut slot may be provided on the secondary container, with a corresponding protrusion on the main case. A further alternative is magnetic attachment means.

Using an undercut slot and corresponding protrusion to releasably attach the secondary container to the main case is advantageous, since the slots and protrusions may easily be formed integrally with the main case and with the secondary container.

Multiple secondary containers may be provided. Where multiple secondary containers are provided, the secondary containers may include attachment means for releasably attaching the secondary containers to each other. As described above, a protrusion may be provided on an exterior rear surface of each secondary container for corresponding with an undercut slot on the main case. A slot may also be provided on an exterior front surface of each secondary container. In this way, each secondary container may be releasably attached either to the main case, or to another secondary container. This allows the multiple secondary containers to be removed from the main case and arranged in any configuration.

The secondary storage containers may be attached to the outside of the case at various points, and used to build up a larger storage unit.

Releasable attachments means may additionally be provided on an exterior surface of the ends of the main case. The attachment means on the ends of the case may be used for attaching secondary containers, as described above, and may also be used for joining multiple main cases together. Any number of additional desk storage accessories may be provided with corresponding attachment means for attachment to the main case.

The storage case may form part of a larger modular desk system, when it is, for example, at the user's home. When the user wishes to travel, the portable desk tidy may be detached from the additional desk accessories, the secondary containers may be placed within the main case, and the closure installed. The user may then travel with the materials which he or she requires. When the user reaches his or her destination, the secondary containers may be removed from the main case to deploy the portable desk tidy, providing easy access to pens, pencils and the like. When the user returns home, the portable desk tidy system may be reattached to the additional desk accessories.

Advantages of Examples of the Invention

1. The storage case can store a wide range of stationery and other items, including pens, pencils and paper. Other items for storage may include, as examples gardening and sewing tools and equipment.

2. The storage case can hold smaller items in the drawer unit as well as longer, larger items and paper in the main storage unit and all the items are visible and accessible when the case is opened.

3. The storage case is simple to close and store away in any position—upright, on its side or front, due to its simple, rectangular form.

4. The storage case is easy to carry with its rigid handle that extends upwards into a carrying position. The handle retracts down easily to join the outer, rectangular form of the storage case.

5. The detachable, slip resistant mat can be separated from the case and used to provide a flat surface to rest on when drawing. The mat can be available in different sizes and different degrees of thickness and weight so as to provide a suitable, smooth working surface. The mat is designed to have a slip resistant surface so that it doesn't move around when worked on.

6. The magnetised base of the storage case can attach to the magnetised mat so as to provide an all in one working station. This is ideal for when on the move so that the storage case and mat is one unit. And because the mat is slip resistant it means that the chances of items going missing or falling are minimised.

7. The storage case allows for the compact and convenient transportation of the above mentioned stationery items. When performing craft activities on the move, the user has access to all of the required materials, including a mat for providing a smooth working surface.

8. The side walls and back walls being magnetised or having other attachment means for the attachment of secondary containers means that the storage case is extendable in its storage and operating functions.

9. The secondary containers can fit into the storage case so that the individual containers within the storage case are interchangeable.

10. The angled side wall sections of the door and of the fixed side walls provide easy access to the interior of the ox when the door is fully open.

The invention claimed is:

1. A storage case having a rectangular base, side walls and front and rear walls upstanding from the base, and a top wall, wherein the front wall has a lower half fixed to the base and side walls and an upper half, at least a major section of the top wall being integral with the upper half of the front wall, the upper half of the front wall being movable between a closed position and a fully open position in which it is folded down over the lower half of the front wall, the top wall being substantially co-planar with the base when in the fully open position; and a carrying handle, said carrying handle being rigid and slidable in channels provided in the rear wall and/or the side walls of said storage case between a retracted position in which an upper edge of said handle is substantially co-planar with said top wall and an extended position in which the upper edge extends beyond the top wall and the handle can be used for carrying the case.

2. A storage case according to claim 1, wherein said handle comprises a substantially rectangular panel and said rear wall is provided with a recess having opposing side edges, wherein the side edges of said rectangular panel slidably engage with respective side edges of said recess, in use, to enable said handle to slide within said recess between said extended and retracted positions.

3. A storage case according to claim 2, wherein, when said handle is in said retracted position, it is located within said recess such that its rear surface is co-planar with the outer surface of the rear wall.

4. A storage case according to claim 2, wherein the side edges of said recess comprise rails along at least a portion of the length thereof, and the side edges of the panel have respective grooves therein along at least a portion of their length, wherein the grooves and rails slidably engage with each other, in use, to enable the handle to slide within said recess between said extended and retracted positions.

5. A storage case according to claim 1, wherein a tab is provided on the upper edge of the handle, which extends beyond the surface of the top wall when the handle is in the retracted position, to enable said handle to be pulled thereby from the retracted to the extended position.

6. A storage case according to claim 1, further comprising a drawer unit having a compartment formed by a wall section parallel with the at least major section of the top wall and compartment side walls.

7. A storage case according to claim 6, wherein the drawer unit contains one or more drawers.

8. A storage case according to claim 1, comprising one or more storage compartments within the case, wherein the one or more storage compartments are spaced from the rear wall to define a further storage compartment.

9. A storage case according to claim 1, comprising one or more storage containers in the case, the storage containers being removable from the case.

10. A storage case according to claim 1, wherein said handle has a rear edge co-planar with the rear wall of the case.

11. A storage case according to claim 10, wherein the top wall is recessed to accommodate the handle in its retracted position.

12. A storage case according to claim 1, further comprising attachment means for attaching items to the exterior of the case.

13. A storage case according to claim 12, wherein said attachment means comprises one or more magnets, or wherein one or more walls of the case are of, or include, magnetic material.

14. A storage case according to claim 12, further comprising a mat removably attached to the case by the attachment means.

15. A storage case according to claim 12, further comprising a mat removably attached to attachment means provided adjacent said storage slot, wherein the mat is attached to the rear wall of the storage case.

16. A storage case according to claim 12, wherein the mat comprises a first section attached to the back wall of the case and a second section attached to the base of the case, the two sections being connected.

17. A storage case according to claim 1, further comprising a secondary storage unit removably attached to an exterior wall of the storage case by cooperative attachment means.

18. A storage case according to claim 17, wherein said cooperative attachment means comprise magnets provided on an exterior wall of said storage case and on an exterior wall of said secondary storage unit.

19. A storage case according to claim 17, wherein said secondary storage unit comprises a receptacle and a lid, wherein said attachment means is provided on said lid.

20. A secondary storage unit for use with a storage case according to claim 1, comprising a receptacle and a lid, wherein attachment means are provided on the lid to enable said secondary storage unit to be attached via cooperative attachment means to an exterior wall of said storage case.

21. Two storage cases, each according to claim 1, a rear surface of one being removably fixed to a rear surface of the other by attachment means, wherein said attachment means is provided on the rear surface of the handle of each respective storage case, or wherein the attachment means is provided on the rear wall of each respective storage case.

22. Two storage cases according to claim 21, wherein the attachment means comprise one or more magnets.

* * * * *